US012421745B2

(12) United States Patent
Johnson

(10) Patent No.: US 12,421,745 B2
(45) Date of Patent: Sep. 23, 2025

(54) WALL SUPPORT SYSTEM AND METHOD FOR CONSTRUCTING MULTISTORY BUILDINGS

(71) Applicant: Rezicast Solutions Pty Ltd, Googong (AU)

(72) Inventor: Michael Johnson, Googong (AU)

(73) Assignee: REZICAST SOLUTIONS PTY LTD, Googong (AU)

( * ) Notice: Subject to any disclaimer, the term of this patent is extended or adjusted under 35 U.S.C. 154(b) by 80 days.

(21) Appl. No.: 18/433,610

(22) Filed: Feb. 6, 2024

(65) Prior Publication Data

US 2024/0352755 A1 Oct. 24, 2024

(30) Foreign Application Priority Data

Apr. 20, 2023 (AU) ..... 2023202437

(51) Int. Cl.
*E04G 25/04* (2006.01)
*E04G 25/00* (2006.01)

(52) U.S. Cl.
CPC ..... *E04G 25/04* (2013.01); *E04G 2025/006* (2013.01)

(58) Field of Classification Search
CPC ..... E04G 25/04; E04G 25/06; E04G 25/065; E04G 2025/006; E04G 11/48
USPC ..... 248/357, 354.1
See application file for complete search history.

(56) References Cited

U.S. PATENT DOCUMENTS 1,461,426 A * 7/1923 Lisowski ..... E04G 11/48 249/48
1,699,503 A * 1/1929 Lampert ..... E04G 17/18 249/211
1,755,708 A * 4/1930 Symons ..... E04G 25/04 52/126.6
2,583,945 A * 1/1952 Jacobs ..... A01G 23/099 254/133 R
2,820,626 A * 1/1958 Hedeen ..... B60S 5/00 254/113
3,355,136 A * 11/1967 Staples ..... F16M 11/046 248/352
3,742,662 A * 7/1973 Ballou ..... E04G 25/04 248/188.4

(Continued)

FOREIGN PATENT DOCUMENTS

DE 102012220751 A1 * 5/2014 ..... E04G 11/365
EP 1921226 A2 * 5/2008 ..... E04G 21/3242

(Continued)

*Primary Examiner* — Eret C McNichols

(57) ABSTRACT

A wall support system may include a top support plate locatable on a top surface of a floor of the above ground level; a bottom support plate locatable beneath the top support plate on a bottom surface of the floor; a securing means for securing the top support plate to the bottom support plate; a bottom support prop having a first end configured to be coupled to the bottom support plate and a second end configured to be coupled to a load bearing structure associated with the multi-level building; and a top support prop having a first end configured to be coupled to the top support plate and a second end configured to be attached to an inner surface of a pre-cast concrete slab wall substantially vertically positioned on the floor of the above ground level.

16 Claims, 9 Drawing Sheets

(56) References Cited

U.S. PATENT DOCUMENTS 4,122,645 A * 10/1978 Tooley ..... E04G 25/065 248/354.3
4,261,149 A * 4/1981 Gustafson ..... E04B 1/34352 52/657
4,546,581 A * 10/1985 Gustafson ..... E02D 27/34 52/262
4,576,354 A * 3/1986 Blessing, Sr. ..... E04F 21/1805 52/749.1
4,870,789 A * 10/1989 Clark ..... E02D 35/00 52/126.5
5,409,192 A * 4/1995 Oliver ..... E04B 1/34352 248/577
5,862,635 A * 1/1999 Linse ..... E04H 9/14 248/354.3
5,870,866 A * 2/1999 Herndon ..... E02D 27/48 52/126.6
5,979,854 A * 11/1999 Lundgren ..... E04F 21/1805 248/354.3
6,152,434 A * 11/2000 Gluck ..... F16M 13/027 254/93 H
6,247,882 B1 * 6/2001 Huang ..... B60P 7/15 410/151
6,467,741 B1 * 10/2002 Shih ..... E04G 25/061 248/200.1
7,225,588 B2 * 6/2007 Nakamura ..... F16F 7/00 52/167.3
7,255,312 B2 * 8/2007 Melic ..... E04G 21/3233 248/200.1
7,658,219 B2 * 2/2010 Whittemore ..... E04G 21/243 248/200.1
8,002,229 B2 * 8/2011 Hewson ..... E04G 25/06 248/161
8,578,664 B2 * 11/2013 Wrightman ..... E04B 2/702 52/23
9,663,962 B1 * 5/2017 Whittemore ..... E04G 21/24
10,487,469 B2 * 11/2019 Reusing ..... E04B 1/34352
10,711,472 B2 * 7/2020 Bond ..... E04G 11/38
10,760,602 B2 * 9/2020 Fenwick ..... F16B 5/02
10,968,649 B1 * 4/2021 Whittemore ..... E04G 25/00
11,066,824 B2 * 7/2021 Hansort ..... E04C 5/16
11,299,863 B2 * 4/2022 Reusing ..... E04B 1/34352
11,814,809 B1 * 11/2023 Tran ..... E02D 35/00
12,006,710 B2 * 6/2024 Read ..... E04G 7/307
12,215,512 B2 * 2/2025 Cigala ..... E04G 25/06
12,252,892 B2 * 3/2025 Bond ..... E04G 11/50
2004/0194418 A1 * 10/2004 Gouley ..... E04G 25/04 248/200.1
2004/0217239 A1 * 11/2004 Chuang ..... F16M 11/28 248/125.8
2010/0207009 A1 * 8/2010 Nishijima ..... E04B 1/164 249/18
2011/0042539 A1 * 2/2011 Melic ..... E04G 21/3233 24/457
2012/0233955 A1 * 9/2012 Tsai ..... E04H 9/0237 52/655.1
2013/0139452 A1 * 6/2013 Tsai ..... E04B 1/98 52/655.1
2014/0356076 A1 * 12/2014 Hale ..... E02D 5/54 405/255
2018/0116887 A1 * 5/2018 Miller ..... F16M 13/027
2019/0063087 A1 * 2/2019 Lutes ..... E04G 17/14
2021/0054587 A1 * 2/2021 Reusing ..... E02D 5/223
2022/0003012 A1 * 1/2022 MacKarvich ..... E04G 25/08
2024/0175275 A1 * 5/2024 Sturm ..... E04G 17/00
2025/0052087 A1 * 2/2025 Moore ..... E04G 5/16

FOREIGN PATENT DOCUMENTS

KR 20150015727 A * 2/2015 ..... B63B 9/06
WO WO-2009077793 A1 * 6/2009 ..... E04G 25/061

* cited by examiner

WALL SUPPORT SYSTEM AND METHOD FOR CONSTRUCTING MULTISTORY BUILDINGS

CROSS-REFERENCE TO RELATED APPLICATIONS

This application claims priority to, and hereby incorporates by reference in its entirety for all purposes, Australia Patent Application No. 2023202437, filed Apr. 20, 2023 and entitled "A WALL SUPPORT SYSTEM AND METHOD FOR CONSTRUCTING MULTISTORY BUILDINGS."

TECHNICAL FIELD

The present invention relates to a wall support system which is particularly configured for the rapid construction of a multi-level building and more particularly to a multi-level building having walls formed from pre-cast concrete.

BACKGROUND

Any discussion of documents, acts, materials, devices, articles or the like which has been included in this specification is solely for the purpose of providing a context for the present invention. It is not to be taken as an admission that any or all of these matters form part of the prior art base or were common general knowledge in the field relevant to the present invention as it existed in Australia or elsewhere before the priority date of this application.

Concrete panels are becoming increasingly common for use in constructing multi-storing buildings and can be used for forming floors, walls and ceilings. Conventionally, concrete panels were formed on site. However, in-situ panel formation is time consuming due to the time required to form the slab and wait for the concrete to sufficiently cure. As such, the industry has moved toward using pre-cast concrete panels that are formed off-site (and often in advance of the build) and shipped when ready to be installed. Pre-cast panels are thus well suited for rapid construction, significantly reducing the time from project approval to occupancy.

A method of constructing buildings using pre-cast concrete panels is described in the Applicant's Australian Patent No. 2021107586 ("the '586 Patent"), entitled "Construction of a building using precast panels," which was granted on Dec. 15, 2021, published on Jan. 6, 2022, the entire contents of which are hereby incorporated herein by reference for all purposes. The disclosure details a construction method whereby novel brackets and joining techniques are used to assemble and join precast concrete wall panels. At ground level, wall panels are anchored to and supported by a concrete floor slab.

The method disclosed in the '586 Patent extends to use in forming upper levels of a multi-level building, where the ground level precast wall panels are used to support a timber floor truss system of the upper level. However, due to the substantial weight of the precast wall panels and a lack of any structural footing foundation to which the panels can be anchored on the upper level, it can be particularly difficult to support said upper-level wall panels during construction.

It would be advantageous if there was provided a technique for supporting precast concrete walls panels during construction of an upper level of a multi-level building.

SUMMARY

This summary represents non-limiting embodiments of the disclosure.

In some aspects, the techniques described herein relate to a wall support system for use in constructing walls of an above ground level of a multi-level building, the wall support system including: a top support plate locatable on a top surface of a floor of the above ground level; a bottom support plate locatable beneath the top support plate on a bottom surface of the floor of the above ground level; a securing means for securing the top support plate to the bottom support plate, thereby sandwiching a portion of the floor of the above ground level therebetween; a bottom support prop having a first end configured to be coupled to the bottom support plate and a second end configured to be coupled to a load bearing structure associated with the multi-level building; and a top support prop having a first end configured to be coupled to the top support plate and a second end configured to be attached to an inner surface of a pre-cast concrete slab wall substantially vertically positioned on the floor of the above ground level, wherein the top support prop is configured to extend diagonally from the top support plate to the pre-cast concrete slab wall to support the pre-cast concrete slab wall during construction of the multi-level building.

In some aspects, a length of the top support prop is adjustable to set a vertical positioning of the pre-cast concrete slab wall.

In some aspects, the bottom support plate is configured to bear against a joist, beam, or other floor support structure.

In some aspects, the securing means includes one or more bolts each having a threaded end that passes through a respective opening in the top support plate, extends through a hole in the floor of the above ground level and out a corresponding opening in the bottom support plate for receiving a nut.

In some aspects, the top support plate further includes a top plate projection which extends upwardly from an outer surface terminating in a flanged end and wherein the first end of the top support prop includes a connecting plate having an opening defined therein for receiving the top plate projection.

In some aspects, the top plate projection includes a bolt having a threaded end that is received within a threaded opening defined in the top support plate and wherein the bolt is screwed into the threaded opening for securing the top support prop to the top support plate.

In some aspects, the connecting plate is pivotable with respect to a longitudinal body of the top support prop and wherein, in use, the connecting plate lies flat on the outer surface of the top support plate.

In some aspects, the second end of the top support prop includes a connecting plate which is pivotable with respect to the longitudinal body of the top support prop and which includes an opening defined therein for receiving the securing means for securing the top support prop to the inner surface of the pre-cast concrete slab wall.

In some aspects, the top support plate further includes a second projection which extends upwardly from the outer surface of the top support plate and wherein the first end of a second top support prop includes a connecting plate having an opening defined therein for receiving the second projection and such that in use a second end of the second top support prop connects to a second pre-cast concrete wall.

In some aspects, the bottom support plate further includes a bottom plate projection which extends away from an outer surface terminating in a flanged end and wherein the first end of the bottom support prop includes a floor prop connecting plate having an opening defined therein for receiving a body of the bottom plate projection.

In some aspects, the bottom plate projection includes a bolt having a threaded end that is received within a threaded opening defined in the bottom support plate.

In some aspects, the floor prop connecting plate is pivotable with respect to a longitudinal body of the bottom support prop and wherein, when connected, the floor prop connecting plate lies flat on the outer surface of the bottom support plate.

In some aspects, the top support prop and bottom support props are of a same configuration and are interchangeable.

In some aspects, in use, the bottom support prop extends downwardly in generally a same direction as the top support prop.

In some aspects, the top support plate and bottom support plate are interchangeable.

In some aspects, the techniques described herein relate to a method of constructing walls of an above ground level of a multi-level building, the method including: situating a top support plate on a top surface of a floor of the above ground level; situating a bottom support plate on a bottom surface of the floor of the above ground level; securing the top support plate to the bottom support plate, thereby sandwiching a portion of the floor of the above ground level therebetween; coupling a first end of a bottom support prop to the bottom support plate; coupling a second end of the bottom support prop to a load bearing structure associated with the multi-level building; coupling a first end of a top support prop to the top support plate; and coupling a second end of the top support prop to an inner surface of a pre-cast concrete slab wall substantially vertically positioned on the floor of the above ground level, wherein the top support prop extends diagonally from the top support plate to the pre-cast concrete slab wall, thereby supporting the pre-cast concrete slab wall during construction of the multi-level building.

The features and advantages of the present invention will become further apparent from the following detailed description of preferred embodiments, provided by way of example only, together with the accompanying drawings.

BRIEF DESCRIPTION OF THE DRAWINGS

Objects, features, and advantages of the disclosure will be readily apparent from the following description of certain embodiments taken in conjunction with the accompanying drawings in which.

Figure 1:
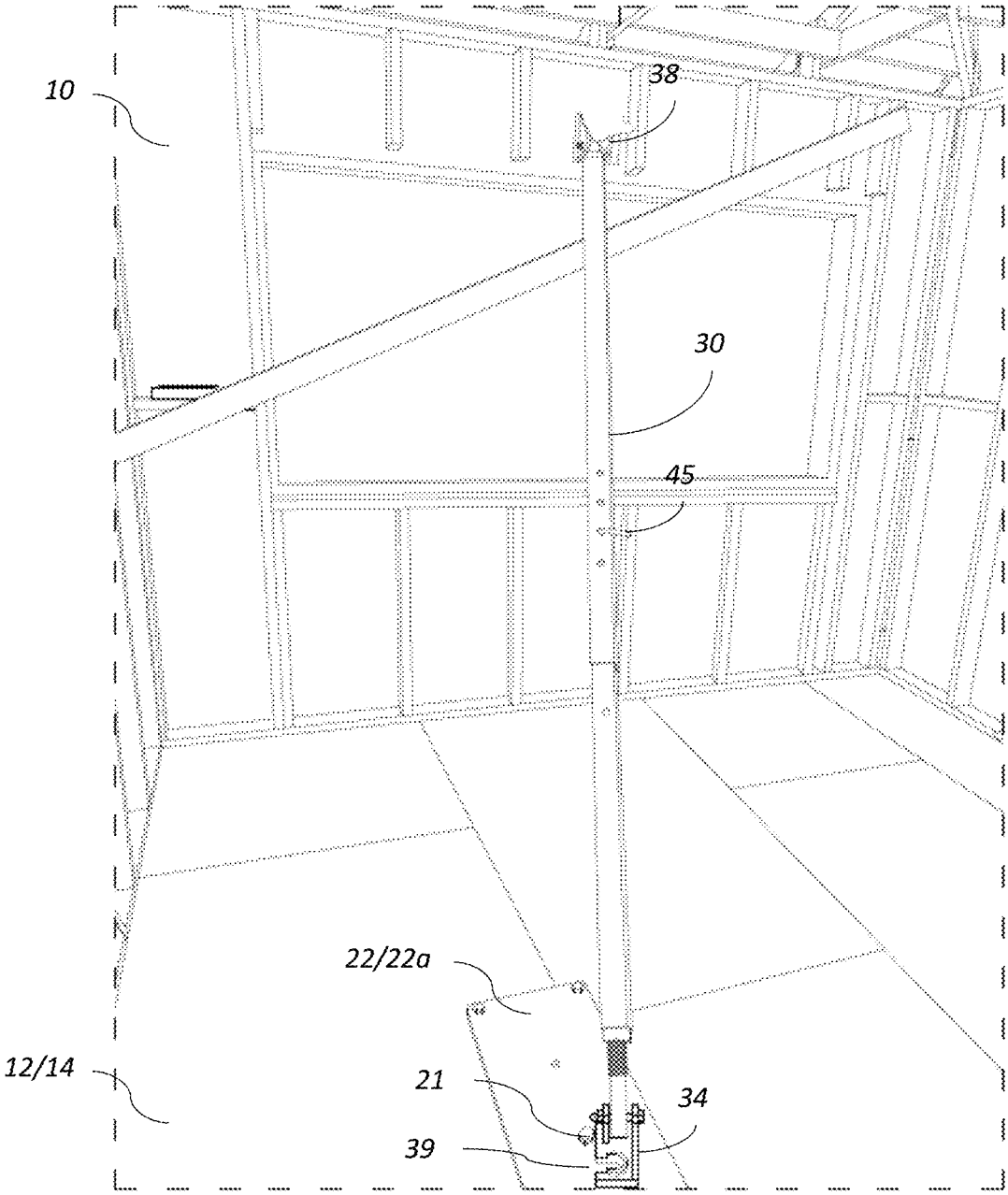
FIG. 1 is an illustrative view of an upper level of a multi-level building showing part of a wall prop support system in accordance with some embodiments.

To facilitate understanding, identical reference numerals have been used, where possible, to designate identical elements that are common to the figures. It is contemplated that elements disclosed in one embodiment may be beneficially utilized in other embodiments without specific recitation. Moreover, the description of an element in the context of one drawing is applicable to other drawings illustrating that element.

DETAILED DESCRIPTION

Embodiments described herein relate to a wall support system for use in constructing walls of an above ground level of a multi-level building. Techniques described herein are suited for use with any construction method whereby the building comprises an above ground level having a floor supported by a floor truss system, such as described in the Applicant's afore-described Australian Patent No. 2021107586, which published on Jan. 6, 2022 and is hereby incorporated by reference in its entirety for all purposes.

An illustration of an upper level of a multi-level building having an upper wall panel 10 temporarily located on an above ground floor 12 is shown in FIG. 1. In this case, the above ground floor 12 comprises a timber floor surface 14 (e.g., comprising particle board sheets) supported by an underlying timber floor truss system 16 (see FIG. 7), formed using techniques well understood in the art. A depth of the individual floor trusses may vary from build to build but will typically range between 200 to 450 mm.

The upper wall panel 10 is typically lifted into position using a crane and may be temporarily supported by the crane until it has been connected to a wall support system as described herein. It will be understood that the upper wall panel 10 may form part of either an internal or external wall.

Figure 2A:
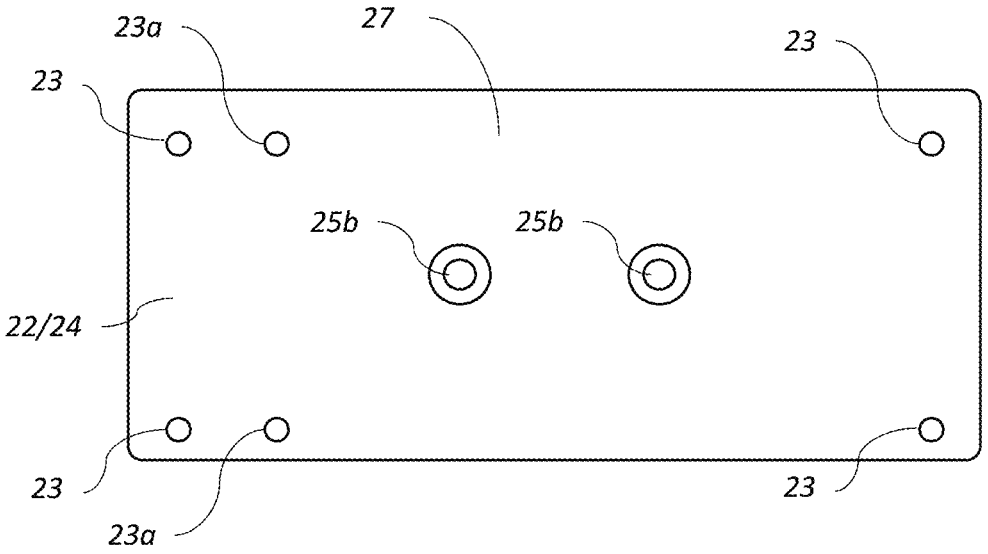
FIG. 2A shows an inner face of a support plate in accordance with some embodiments.
Figure 2B:
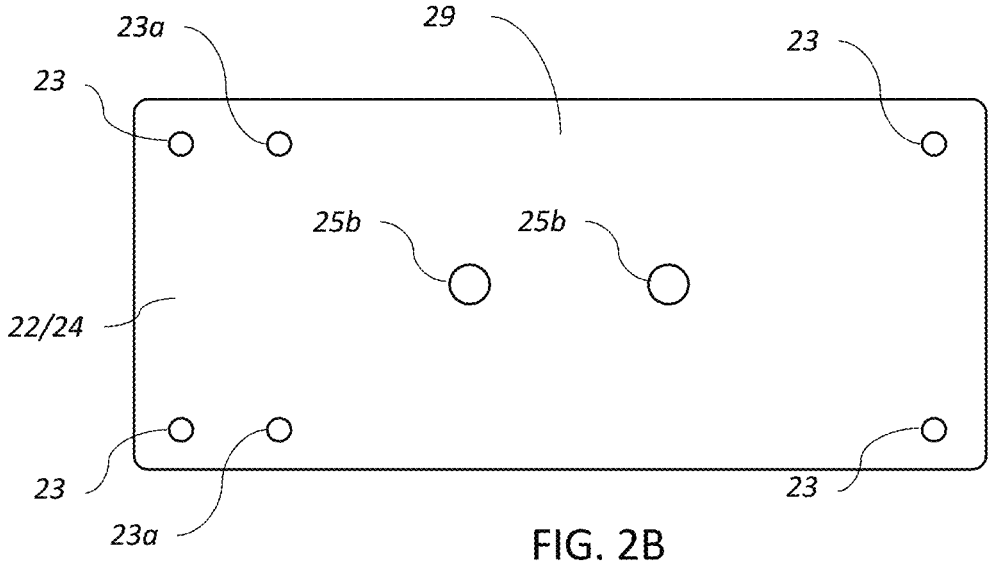
FIG. 2B shows an outer face of the support plate in accordance with some embodiments.
Figure 2C:
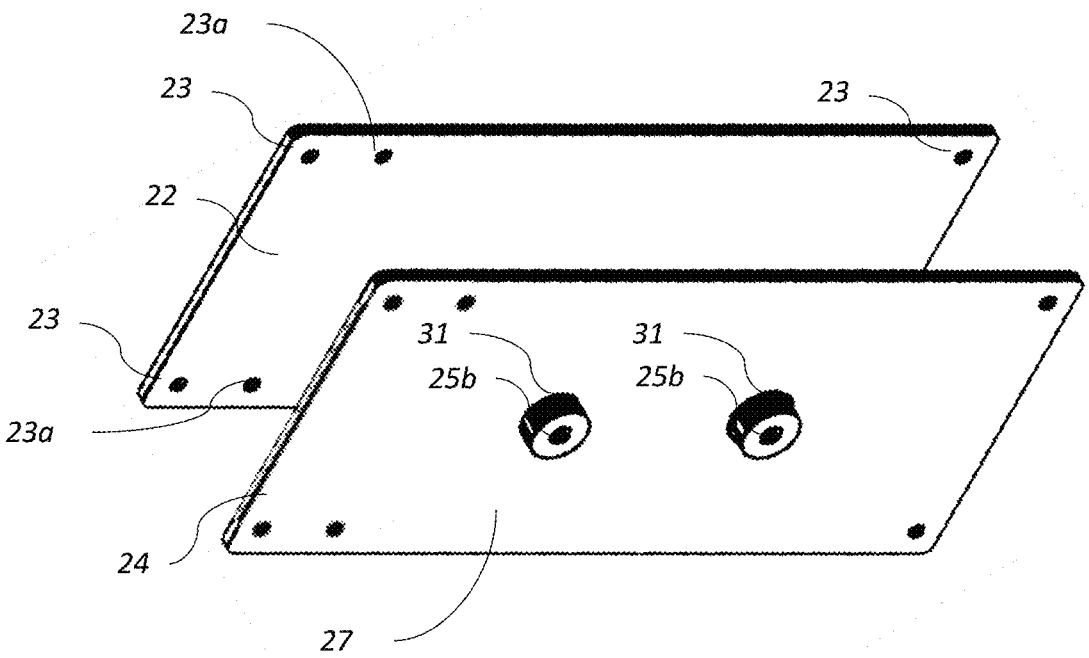
FIG. 2C is a perspective view showing top and bottom support plates in accordance with some embodiments.

As shown in FIGS. 2A through 2C, the wall support system according to embodiments described herein comprises a top support plate 22 configured to locate on the timber floor surface 14 and a bottom support plate 24 configured to locate on a bottom surface of the floor 12 (i.e., underneath the top support plate 22 and typically bearing against a part of the floor truss system 16, such as a joist or beam). According to the illustrated embodiment, the top and bottom support plates 22, 24 are identical in shape and configuration and are formed of steel. An inner face 27 of the support plates is shown in FIG. 2A, while an outer face 29 is shown in FIG. 2B. In use, the inner face 27 of the top support plate 22 bears against the timber floor surface 14. The inner face 27 of the bottom support plate 24 bears against two or more bottom chords of adjacent floor trusses that span between opposing ground floor walls. Through holes 23 located inwardly of each corner are provided for receiving a securing means as described below. An additional pair of through holes 23*a* are provided to accommodate for differing truss spacing.

Figure 4:
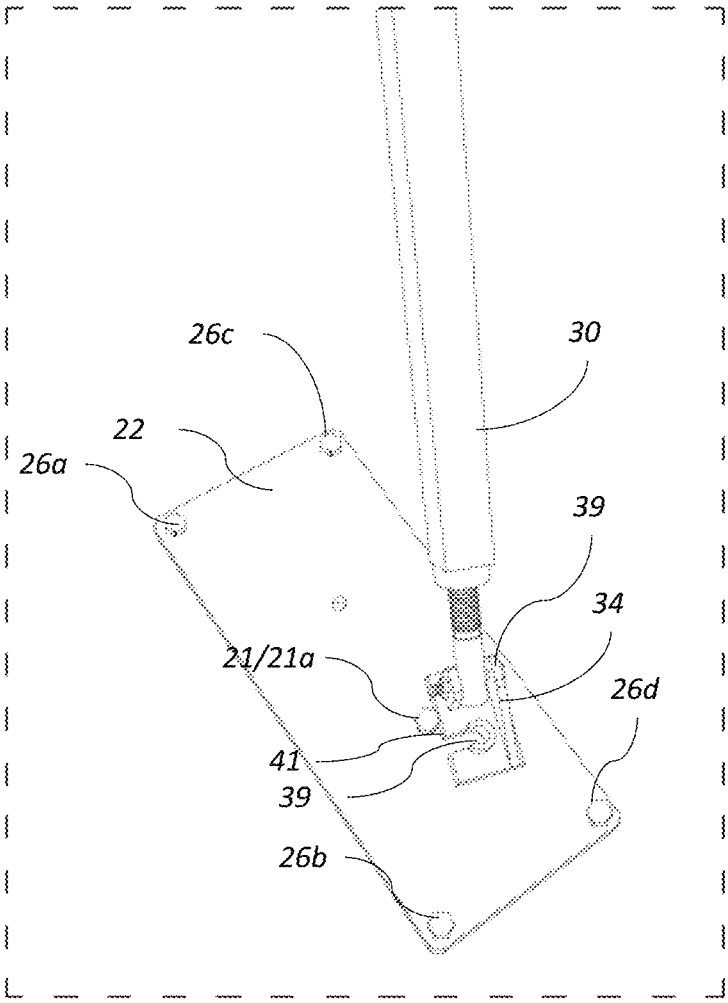
FIG. 4 is a closeup view of the top support plate shown in FIG. 1 during positioning of the wall prop in accordance with some embodiments.
Figure 5:
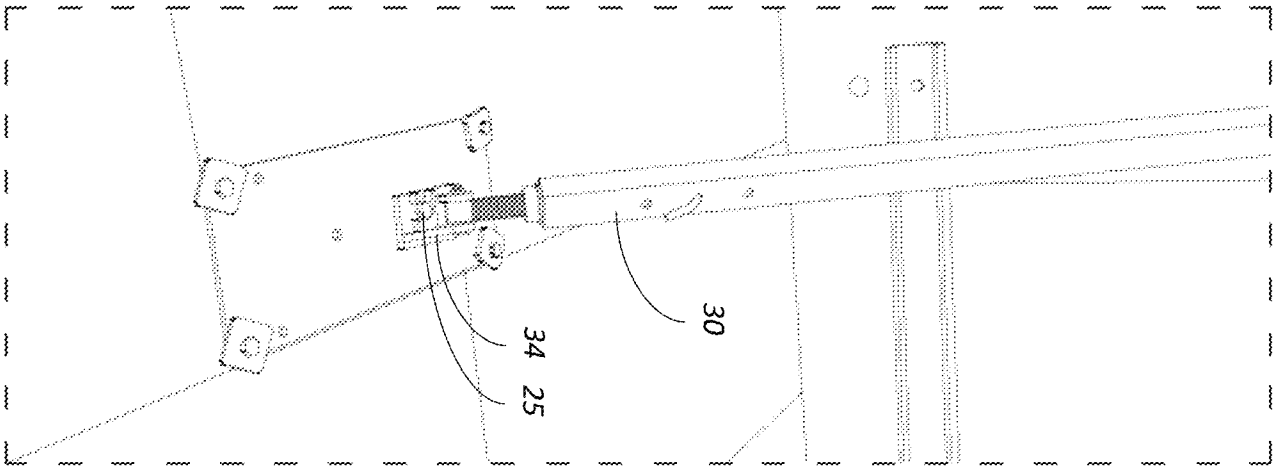
FIG. 5 is a closeup view of the top support plate shown in FIG. 1 with the wall prop secured thereto in accordance with some embodiments.

As is evident from FIGS. 1, 4 and 5, a projection 21 extends from the outer face 29 of each plate 22, 24, terminating in a flanged end. According to the illustrated embodiment, the projection 21 is removably coupled to each plate and takes the form of a bolt (preferably a high tensile steel bolt) having a threaded end that is received within a threaded opening 25*b* defined in a body of the respective plates 22, 24. According to the illustrated embodiment, each plate includes a pair of threaded openings 25*b* to accommodate multiple props (i.e., for supporting multiple walls), as will be described in more detail in subsequent paragraphs with reference to FIG. 8. To ensure sufficient threaded engagement, the threaded openings 25*b* may extend beyond the inner face into (and through, if desired) bodies 31 that project from the inner face 27, as shown in FIG. 2C. The threaded bodies 31 may, for example, be welded on to the plates 22, 24.

In an alternative embodiment to that shown in the figures, the projection(s) 21 may be welded to, or otherwise integrally formed with, each plate 22, 24.

Figure 3:
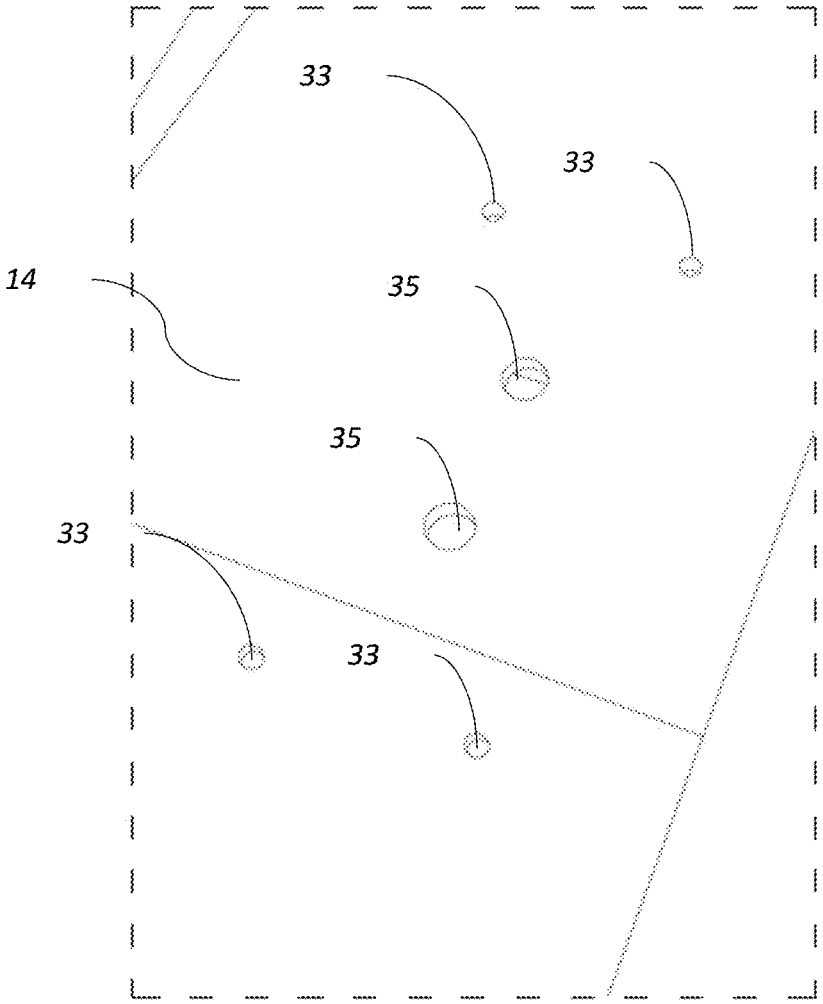
FIG. 3 is a perspective view showing a section of floor of an upper level with bolt holes drilled therein in accordance with some embodiments.

As shown in FIG. 4, the wall support system further comprises a securing means 26 for joining the top and bottom support plates 22, 24. In FIG. 4, the securing means 26 takes the form of one or more bolts (in this case four high tensile bolts 26*a*, 26*b*, 26*c*, 26*d* for passing through corresponding holes 23 in each plate corner) that, in use, join the top and bottom support plates 22, 24 and can be tightened using nuts for sandwiching a portion of the floor 12 therebetween. It will be understood that the length of the bolts may vary depending on a depth of the floor truss system. FIG. 3 depicts a section of the timber floor surface 14 with holes 33 drilled therein for receiving the bolts 26*a*, 26*b*, 26*c*, 26*d*, as well as holes 35 to accommodate the threaded bodies 31 that project from the inner face 27 of the top support plate 22. It will be understood that other forms of securing means 26 may also be implemented. For example, a length of threaded rod with a washer and nut secured on either end could be used as the securing means 26 for joining the top and bottom support plates 22, 24. Yet another form of securing means 26 could take the form of a G-clamp or other suitable clamping arrangement.

The wall support system further comprises a pair of support props 30, 32. The props 30, 32 shown in the figures are interchangeable and thus identical in configuration. According to the illustrated embodiment, prop 30 is used for supporting the upper wall panel 10, while prop 32 is used as a bracing prop and connects to a load bearing structure associated with the multi-level building. The load bearing structure will typically be the concrete floor slab 43 that forms the ground floor of the building.

More particularly, ends 34, 36 of each prop 30, 32 couple to a respective connecting plate 38 which is pivotable with respect to a longitudinal prop body. As shown, the props 30, 32 extend diagonally between the securing points and can operate in both compression and traction. The connecting plates 38 may be formed of steel or the like and are configured to pivot about a respective pivot pin which extends through each end 34, 36. Each connecting plate 38 has an opening 39 for receiving either a securing means 26 or support plate projection 21. The opening 39 may extend into a sidewall 41 thereof, thereby forming a channel for receiving a body of the plate projection 21 that facilitates sliding engagement therewith (see particularly FIG. 4).

A length of each prop 30, 32 is adjustable for reasons that will become evident in subsequent paragraphs. According to the illustrated embodiment, the props 30, 32 have an adjustable telescopic body consisting of an inner tube and outer tube with a cotter pin 45, hitch pin or the like used for fast locking the tubes in place once a desired length has been achieved. At least one of the ends 34, 36 may also include a threaded section that can be rotated in and out of the telescopic body for fine tuning the length.

Figure 7:
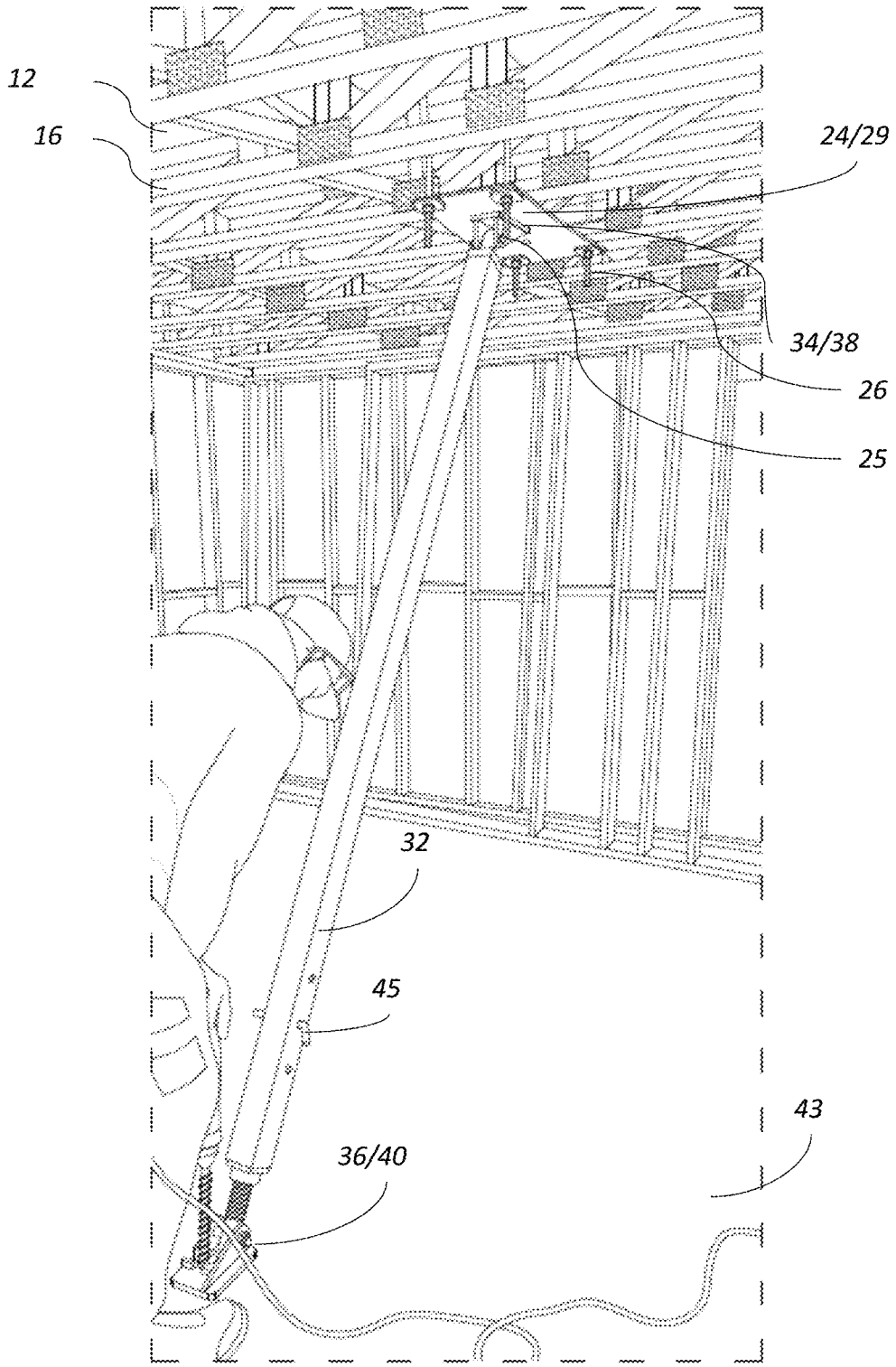
FIG. 7 is an illustrative view of a lower level of a multi-level building showing the remaining section of the wall prop support system of FIG. 1 in accordance with some embodiments.

In use, and with particular reference to FIG. 7, an end 34 of the bottom support prop 32 is removably coupled to an outer face 29 of the bottom support plate 24 by sliding the corresponding plate 38 over the outer face 29 such that the projection 25 is guided into the channel and entrapped within the opening 39. Where the projection 25 is a screw, it may thereafter be screwed down for securing the prop 32 to the bottom support plate 24. The other end 36 is secured to the concrete floor slab 43, e.g., by using a masonry screw, chemical anchor, sleeve anchor, concrete screw bolt or other suitable concrete fastening member that extends through the opening 39 and into the slab 43.

Figure 6:
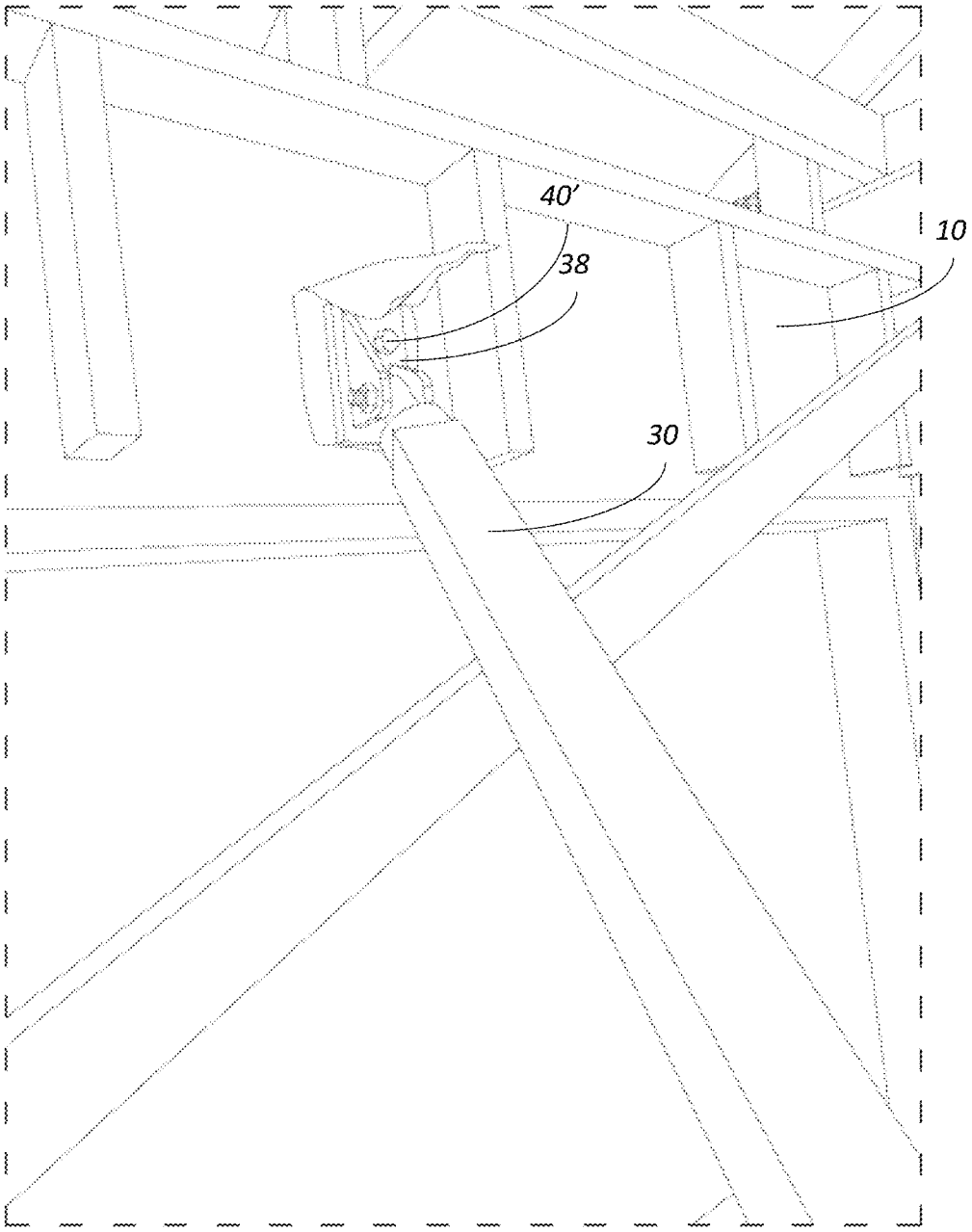
FIG. 6 is a closeup view showing attachment of the wall prop to the wall of FIG. 1 in accordance with some embodiments.

Similarly, and returning to FIG. 1, end 34 of the top support prop 30 is removably coupled to an outer face 22*a* of the top support plate 22 using the same technique as described above for the bottom plate. The other end 36 is secured to an inner face of the upper wall panel 10 (see particularly FIG. 6). Again, this may be achieved by using a masonry screw, chemical anchor, sleeve anchor, concrete screw bolt or other suitable concrete fastening member that passes through the opening 39 and extends into the panel 10. Alternatively, as shown in FIG. 6, the panel 10 may comprise a threaded ferrule precast in the inner wall and in this case a bolt 40' may be used to secure the plate 38 to the panel 10. Preferably, the bottom support prop extends downwardly in generally the same diagonal direction as the top support prop to suitably transfer a load of the upper wall panel downwardly towards the concrete floor slab.

It will be understood that the length of the props may be adjusted to achieve a desired length for coupling and subsequently adjusted post coupling to achieve the necessary tension and vertical alignment of the upper wall panel 10 for installation. Once set, the wall prop system advantageously maintains vertical alignment of the pre-cast concrete and prevents lateral movement wall during construction of the multi-level building.

Figure 8:
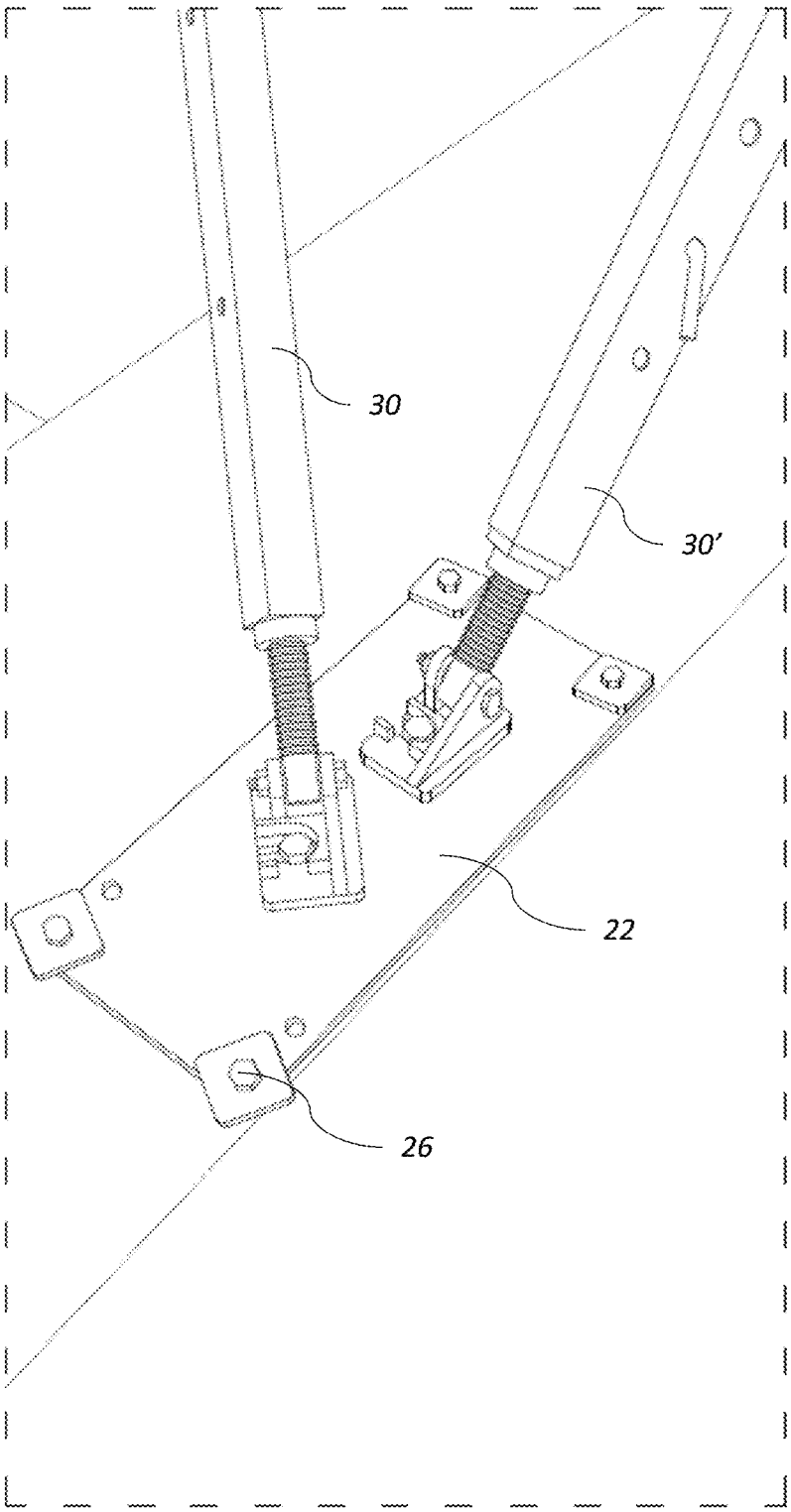
FIG. 8 shows the support plate of FIG. 2A connected to a plurality of support props in accordance with some embodiments.

As shown in FIG. 8, a top plate 22 may be connected to multiple props 30, 30' for use in supporting multiple pre-cast concrete wall panels during construction of the multi-level building. It will be understood that the bottom plate 24 may also couple to multiple props that extend diagonally in directions corresponding to the upper props 30, 30' for suitably transferring the wall loads.

While a number of preferred embodiments have been described, it will be appreciated by persons skilled in the art that numerous variations and/or modifications may be made to the invention without departing from the spirit or scope of the invention as broadly described. The present embodiments are, therefore, to be considered in all respects as illustrative and not restrictive.

In the foregoing description and in the accompanying drawings, specific terminology has been set forth to provide a thorough understanding of the disclosed embodiments. In some instances, the terminology or drawings may imply specific details that are not required to practice the invention.

To avoid obscuring the present disclosure unnecessarily, well-known components are shown in block diagram form and/or are not discussed in detail or, in some cases, at all.

Unless otherwise specifically defined herein, all terms are to be given their broadest possible interpretation, including meanings implied from the specification and drawings and meanings understood by those skilled in the art and/or as defined in dictionaries, treatises, etc. As set forth explicitly herein, some terms may not comport with their ordinary or customary meanings.

As used in the specification and the appended claims, the singular forms "a," "an" and "the" do not exclude plural referents unless otherwise specified. The word "or" is to be interpreted as inclusive unless otherwise specified. Thus, the phrase "A or B" is to be interpreted as meaning all of the following: "both A and B," "A but not B," and "B but not A." Any use of "and/or" herein does not mean that the word "or" alone connotes exclusivity.

As used in the specification and the appended claims, phrases of the form "at least one of A, B, and C," "at least one of A, B, or C," "one or more of A, B, or C," and "one or more of A, B, and C" are interchangeable, and each encompasses all of the following meanings: "A only," "B only," "C only," "A and B but not C," "A and C but not B," "B and C but not A," and "all of A, B, and C."

To the extent that the terms "include(s)," "having," "has," "with," and variants thereof are used in the detailed description or the claims, such terms are intended to be inclusive in a manner similar to the term "comprising," i.e., meaning "including but not limited to."

The terms "exemplary" and "embodiment" are used to express examples, not preferences or requirements.

The term "coupled" is used herein to express a direct connection/attachment as well as a connection/attachment through one or more intervening elements or structures.

The terms "over," "under," "between," and "on" are used herein refer to a relative position of one feature with respect to other features. For example, one feature disposed "over" or "under" another feature may be directly in contact with the other feature or may have intervening material. Moreover, one feature disposed "between" two features may be directly in contact with the two features or may have one or more intervening features or materials. In contrast, a first feature "on" a second feature is in contact with that second feature.

The term "substantially" is used to describe a structure, configuration, dimension, etc. that is largely or nearly as stated, but, due to manufacturing tolerances and the like, may in practice result in a situation in which the structure, configuration, dimension, etc. is not always or necessarily precisely as stated. For example, describing two lengths as "substantially equal" means that the two lengths are the same for all practical purposes, but they may not (and need not) be precisely equal at sufficiently small scales. As another example, a structure that is "substantially vertical" would be considered to be vertical for all practical purposes, even if it is not precisely at 90 degrees relative to horizontal.

The drawings are not necessarily to scale, and the dimensions, shapes, and sizes of the features may differ substantially from how they are depicted in the drawings.

Although specific embodiments have been disclosed, it will be evident that various modifications and changes may be made thereto without departing from the broader spirit and scope of the disclosure. For example, features or aspects of any of the embodiments may be applied, at least where practicable, in combination with any other of the embodiments or in place of counterpart features or aspects thereof. Accordingly, the specification and drawings are to be regarded in an illustrative rather than a restrictive sense.

The invention claimed is:

1. A wall support system for use in constructing walls of an above ground level of a multi-level building, the wall support system comprising:

a top support plate locatable on a top surface of a floor of the above ground level;

a bottom support plate locatable beneath the top support plate on a bottom surface of the floor of the above ground level;

a securing means for securing the top support plate to the bottom support plate, thereby sandwiching a portion of the floor of the above ground level therebetween;

a bottom support prop having a first end configured to be coupled to the bottom support plate and a second end configured to be coupled to a load bearing structure associated with the multi-level building; and a top support prop having a first end configured to be coupled to the top support plate and a second end configured to be attached to an inner surface of a pre-cast concrete slab wall substantially vertically positioned on the floor of the above ground level, wherein the top support prop is configured to extend diagonally from the top support plate to the pre-cast concrete slab wall to support the pre-cast concrete slab wall during construction of the multi-level building.

2. The wall support system in accordance with claim 1, wherein a length of the top support prop is adjustable to set a vertical positioning of the pre-cast concrete slab wall.

3. The wall support system in accordance with claim 1, wherein the bottom support plate is configured to bear against a joist, beam, or other floor support structure.

4. The wall support system in accordance with claim 1, wherein the securing means comprises one or more bolts each having a threaded end that passes through a respective opening in the top support plate, extends through a hole in the floor of the above ground level and out a corresponding opening in the bottom support plate for receiving a nut.

5. The wall support system in accordance with claim 1, wherein the top support plate further comprises a top plate projection which extends upwardly from an outer surface terminating in a flanged end and wherein the first end of the top support prop comprises a connecting plate having an opening defined therein for receiving the top plate projection.

6. The wall support system in accordance with claim 5, wherein the top plate projection comprises a bolt having a threaded end that is received within a threaded opening defined in the top support plate and wherein the bolt is screwed into the threaded opening for securing the top support prop to the top support plate.

7. The wall support system in accordance with claim 5, wherein the connecting plate is pivotable with respect to a longitudinal body of the top support prop and wherein, in use, the connecting plate lies flat on the outer surface of the top support plate.

8. The wall support system in accordance with claim 7, wherein the second end of the top support prop comprises a connecting plate which is pivotable with respect to the longitudinal body of the top support prop and which comprises an opening defined therein for receiving the securing means for securing the top support prop to the inner surface of the pre-cast concrete slab wall.

9. The wall support system in accordance with claim 5, wherein the top support plate further comprises a second projection which extends upwardly from the outer surface of the top support plate and wherein the first end of a second top support prop comprises a connecting plate having an opening defined therein for receiving the second projection and such that in use a second end of the second top support prop connects to a second pre-cast concrete wall.

10. The wall support system in accordance with claim 1, wherein the bottom support plate further comprises a bottom plate projection which extends away from an outer surface terminating in a flanged end and wherein the first end of the bottom support prop comprises a floor prop connecting plate having an opening defined therein for receiving a body of the bottom plate projection.

11. The wall support system in accordance with claim 10, wherein the bottom plate projection comprises a bolt having a threaded end that is received within a threaded opening defined in the bottom support plate.

12. The wall support system in accordance with claim 11, wherein the floor prop connecting plate is pivotable with respect to a longitudinal body of the bottom support prop and wherein, when connected, the floor prop connecting plate lies flat on the outer surface of the bottom support plate.

13. The wall support system in accordance with claim 1, wherein the top support prop and bottom support props are of a same configuration and are interchangeable.

14. The wall support system in accordance with claim 1, wherein, in use, the bottom support prop extends downwardly in generally a same direction as the top support prop.

15. The wall support system in accordance with claim 1, wherein the top support plate and bottom support plate are interchangeable.

16. A method of constructing walls of an above ground level of a multi-level building, the method comprising:

situating a top support plate on a top surface of a floor of the above ground level;

situating a bottom support plate on a bottom surface of the floor of the above ground level;

securing the top support plate to the bottom support plate, thereby sandwiching a portion of the floor of the above ground level therebetween;

coupling a first end of a bottom support prop to the bottom support plate;

coupling a second end of the bottom support prop to a load bearing structure associated with the multi-level building;

coupling a first end of a top support prop to the top support plate; and coupling a second end of the top support prop to an inner surface of a pre-cast concrete slab wall substantially vertically positioned on the floor of the above ground level, wherein the top support prop extends diagonally from the top support plate to the pre-cast concrete slab wall, thereby supporting the pre-cast concrete slab wall during construction of the multi-level building.

* * * * *